US005258770A

United States Patent [19]

Jones et al.

[11] Patent Number: 5,258,770

[45] Date of Patent: Nov. 2, 1993

[54] GROUND INDEPENDENT FEED NETWORK FOR A MULTITERMINAL ANTENNA

[75] Inventors: David E. Jones, Jeffersonville, Ind.; Wayne L. Bowman, Calabasas, Calif.

[73] Assignee: McDonnell Douglas Corporation, St. Louis, Mo.

[21] Appl. No.: 751,516

[22] Filed: Aug. 29, 1991

[51] Int. Cl.[5] ..... H01Q 21/00

[52] U.S. Cl. ..... 343/853

[58] Field of Search ..... 343/853, 895, 792.5

[56] References Cited

U.S. PATENT DOCUMENTS 3,987,458 10/1976 Reggia et al. ..... 343/895

*Primary Examiner*—John D. Lee
*Assistant Examiner*—Robert E. Wise
*Attorney, Agent, or Firm*—Guy R. Gosnell; Benjamin Hudson, Jr.; Timothy H. Courson

[57] ABSTRACT

A feed network for a multiterminal antenna which provides excitation to the antenna independent of ground. The feed network provides a voltage differential between terminals of the antenna instead of between a common ground point and a terminal so that the antenna achieves enhanced broadband performance via an attached balun for each coaxial cable. The feed network is comprised of a base, through which a plurality of coaxial connector extend, and a plurality of printed circuit boards positioned so as to define a centerline through the feed network. The printed circuit boards have a first side having a first, wide twin lead and a second side having a second, narrow twin lead such that the electrical signals conducted by the feed network are balanced between each pair of first and second twin leads. The twin leads of the printed circuit board are electrically connected to a corresponding connector of the plurality of coaxial connectors. The width of the etched twin lead decreases as it progresses along a linear converging path from the base towards the apex of the feed network at which point the trace of each twin lead is varied to follow a path parallel to a centerline of the feed network. Jumper wires are utilized to connect the twin leads at the apex of the feed network to the terminals of the antenna. The twin leads are spaced such that a single jumper wire may be connected to twin leads from two adjacent printed circuit boards.

2 Claims, 3 Drawing Sheets

GROUND INDEPENDENT FEED NETWORK FOR A MULTITERMINAL ANTENNA

BACKGROUND OF THE INVENTION

The present invention relates generally to feed networks for multiterminal antennas and more particularly to feed networks which are independent of a common ground for multiterminal antennas.

There are currently many uses for multiterminal antennas, such as, communication, navigation, direction finding and remote sensing. These antennas, such as, planar and conical spiral antennas, and other multiterminal antennas typically rely upon a dedicated feed network for the excitation required in order to transmit or detect electromagnetic radiation.

There have been a variety of proposed feed networks for multiterminal antennas. Foremost among these feed networks are those in which each terminal of the multiterminal antenna is fed from a common ground point. A typical manner in which this type of feeding from a common ground point is accomplished is by feeding the multiterminal antenna from a number of coaxial cables wherein the number of coaxial cables is equal to the number of terminals. A center conductor from each coaxial cable is affixed to a terminal of the multiterminal antenna such that each coaxial cable feeds a single terminal of the antenna. The grounded shields of each coaxial cable are thereinafter brought into contact with the other grounded shields of the coaxial cables such that a common ground in established amongst the plurality of coaxial cables.

This manner of feeding a multiterminal antenna wherein each terminal is fed separately and a common ground point for the feeding network is established limits the broadband performance of the antenna. These limitations are typically caused by an absence of a broadband impedance match and the poor realization of a common ground point reducing balun performance.

Therefore, it would be desirable to provide a feed network for a multiterminal antenna in which the excitation of the antenna terminals is provided independent of common ground so that the antenna is capable of providing wider band width performance. Furthermore, it would be desirable to provide a feed network for a multiterminal antenna which is capable of transforming a feed from a plurality of coaxial cables to a plurality of twin lead conductors prior to their electrical connection to the terminals of the antenna.

SUMMARY

There is provided by this invention a feed network for a multiterminal antenna which provides excitation to the antenna independent of a common ground. The feed network provides a voltage differential between terminals of the antenna instead of between a common ground point and a terminal so that the antenna achieves enhanced broadband performance.

The feed network is comprises of a base and a plurality of printed circuit boards positioned so as to define a centerline through the feed network. The base is typically composed of a brass alloy through which a plurality of coaxial connectors extend. Protruding from first side of the base are the threaded portions of the coaxial connectors, while base portion of the connectors lie flush on a second side of the base. The printed circuit boards are typically a fiberglass epoxy material on which twin leads are etched such that the twin leads are comprised of a layer of copper covered by a layer of tin lead. The printed circuit boards have a first side having a twin lead for a neutral signal and a second side having a twin lead for an excitation signal. The twin leads of the printed circuit board are electrically connected to a corresponding connector on the base portion of the coaxial connectors.

The width of the etched twin lead decreases as it progresses from the base towards the apex of the feed network with its width at the base equal to the width of the corresponding connection on the base portion of the coaxial connector. The electrical path from the coaxial connectors and along the twin leads follow a linear converging path to a point slightly below the apex of the printed circuit boards at which point the trace of each twin lead is varied to follow a path parallel to a centerline of the feed network.

Small diameter metallic jumper wires are utilized to connect the twin leads at the apex of the feed network to the terminals of the antenna. The twin leads are spaced such that a single jumper wire may be connected to twin leads from two adjacent printed circuit boards. In this fashion, the excitation energy is applied between terminals of the antenna in a fashion that is independent of a common ground point such that the antenna is capable of enhanced broadband performance.

DETAILED DESCRIPTION OF THE PREFERRED EMBODIMENT

Figure 1:
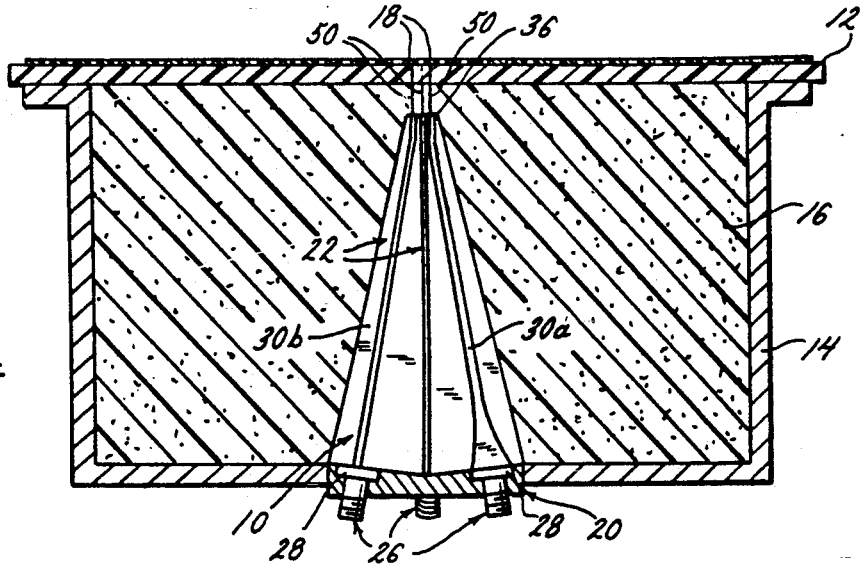
FIG. 1 is a side sectional view of a feed network incorporating the principles of this invention as utilized with a planar, multiterminal antenna.

As shown in FIG. 1, a ground independent feed network 10 may be used to feed a multiterminal antenna 12. While the multiterminal antenna may be of any of the various types well known to those skilled in the art, a planar multiterminal spiral antenna having four arms is shown in FIG. 1 for illustrative purposes. The feed network 10 is attached at its base to a plurality of coaxial lines and at its apex to the multiterminal antenna 12. The feed network 10 is typically placed within a metallic pan 14 which is thereinafter filled with an absorbing material 16 which is well known to those skilled in the art. While the feed network 10 is shown in this instance positioned within a pan 14 filled with an absorbing material 16 it can be used in numerous other configurations, such as within the apex of a conical multiterminal antenna.

Figure 2:
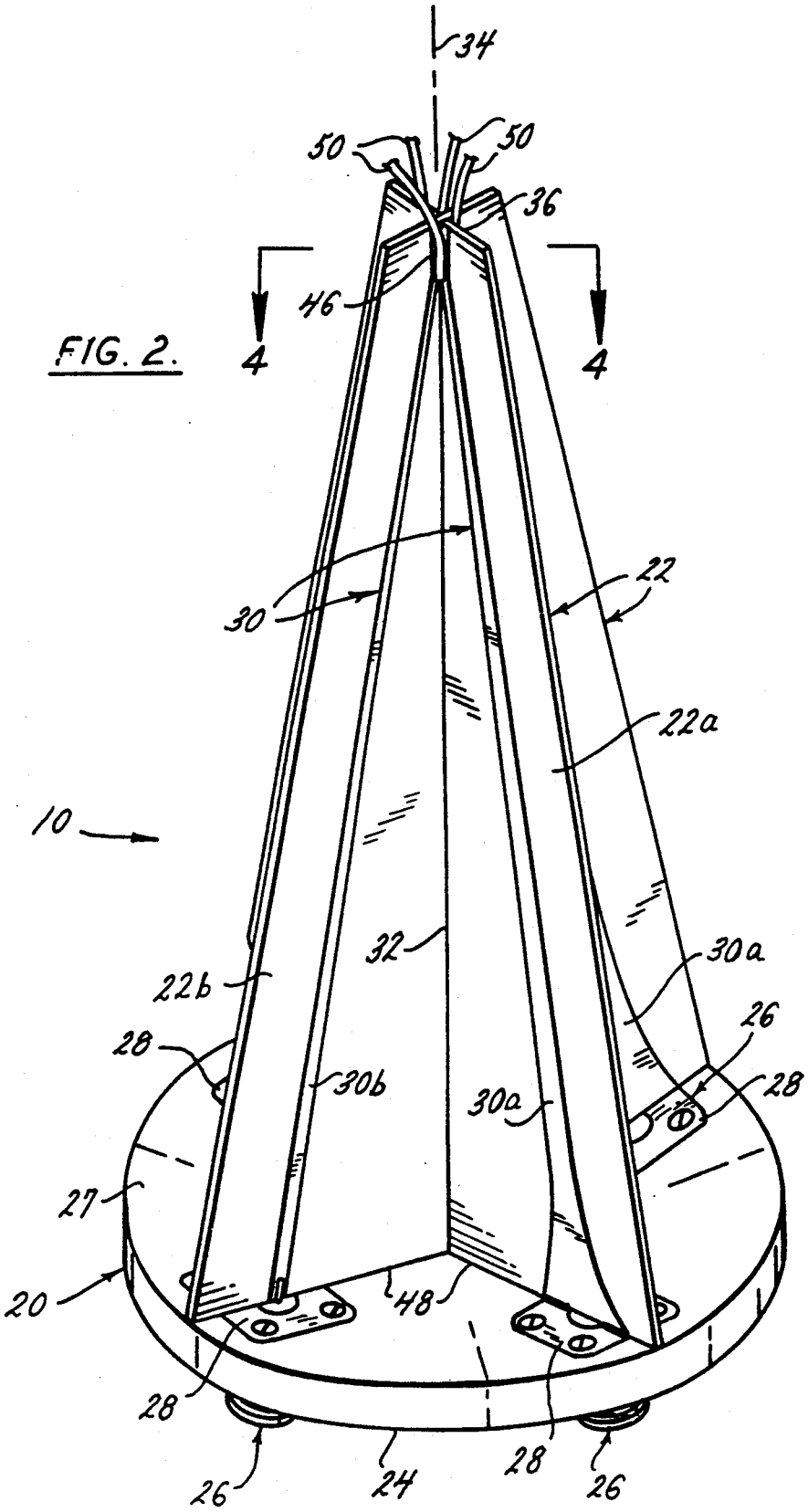
FIG. 2 is a perspective view of a feed network incorporating the principles of this invention.

The feed network 10 which is shown in more detail in FIG. 2, consists primarily of a base 20 and a plurality of printed circuit boards 22. In the particular configuration shown in FIG. 2, the feed network 10 would be utilized to feed a four terminal antenna, however, comparable feed networks may be constructed to feed an antenna having any number of terminals.

The base 20 is typically comprised of a brass alloy through which a plurality of coaxial connectors are fastened and extend. Protruding from a first side 24 of the base 20 are the threaded portion 26 of the connectors while a base portion 28 of the connectors lie flush on a second side of the base 27. The plurality of coaxial cable connectors each provide leads for the center conductors of the coaxial cables and the grounded shields of the coaxial cables from the first side 24 of the base 20 to a second side 27 of the base 20 wherein the leads terminate in the base portion 28 of the connector.

Figure 3:
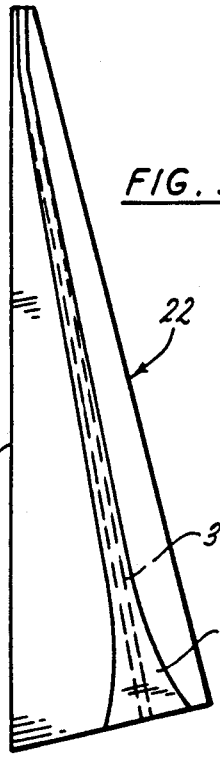
FIG. 3 is a side view of a single printed circuit board.

The base portion of the connectors 28 on the second side 27 of the base 20 serve to provide the transition between the coaxial lines and the etched twin leads 30 on the printed circuit boards 22. Each printed circuit board 22, as shown in FIGS. 2 and 3, has a first side 22*a* having a first twin lead 30*a* etched thereon for connection with the exterior of the base portion 28 of the connector providing access to the grounded shield of the coaxial cable. A second side 22*b* of the printed circuit board 22 has an etched second twin lead 30*b* for carrying the excitation energy to the terminals of the antenna 12. This second twin lead 30*b* is connected to the center of the base portion 28 of the connector which provides access to the center conductor of the coaxial cable. The signals carried by the twin leads 30 are balanced between each pair of first and second twin leads, 30*a* and 30*b* respectively, such that there is effectively no neutral signal. Also, there are an equal number of printed circuit boards 22 as there are coaxial connectors.

The printed circuit boards 22, shown individually in FIG. 3 and in combination in FIG. 2, are arranged such that they all contact one another along a first edge 32 of each printed circuit board 22. The line along which the first edge 32 of the printed circuit boards 22 contact one another is substantially perpendicular to the plane in which the base plate 20 is located and is termed the central axis 34 of the feed network 10. The printed circuit boards 22 are typically positioned such that there is an equal angular displacement between each printed circuit board 22. Furthermore, for feed networks 10 with greater than two printed circuit boards 22, the printed circuit boards 22 are positioned such that the first side 22*a* of a first printed circuit board faces at a slight angular displacement depending on the number of printed circuit boards utilized the second side 22*b* of a second printed circuit board, while the second side 22*b* of the first printed circuit board faces, also at a slight angular displacement, the first side 22*a* of a third printed circuit board.

The base plate 20 and the printed circuit boards 22 are constructed such that the input feed signals carried by the coaxial cables are each fed along a linear converging path so as to minimize reflections of the excitation energy and thereby optimize the antenna's impedence. In order to provide such a linear converging electrical path, the coaxial connectors extending through the base plate 20 are positioned at such an angle that line positioned axially through each coaxial connector, each would converge and intersect at a point along the central axis 34 of the feed network 10 slightly below the apex 36 of the printed circuit boards 22. From the coaxial connectors, the signals pass through the base plate 20 along a linear electrical path to the etched twin leads 30 on the printed circuit boards 22 which follow the same linear converging pattern. This converging pattern is established on the printed circuit boards by etching the twin leads 30 such that they run parallel to the axis of convergence established by the coaxial connectors. As shown in FIG. 2, slightly before the etched twin leads 30 contact one another at the central axis 34 of the feed network 10, the etched twin leads 30 change in direction so as to run parallel to the central axis 34 of the feed network 10 while being slightly displaced from the central axis 34.

Figure 7:
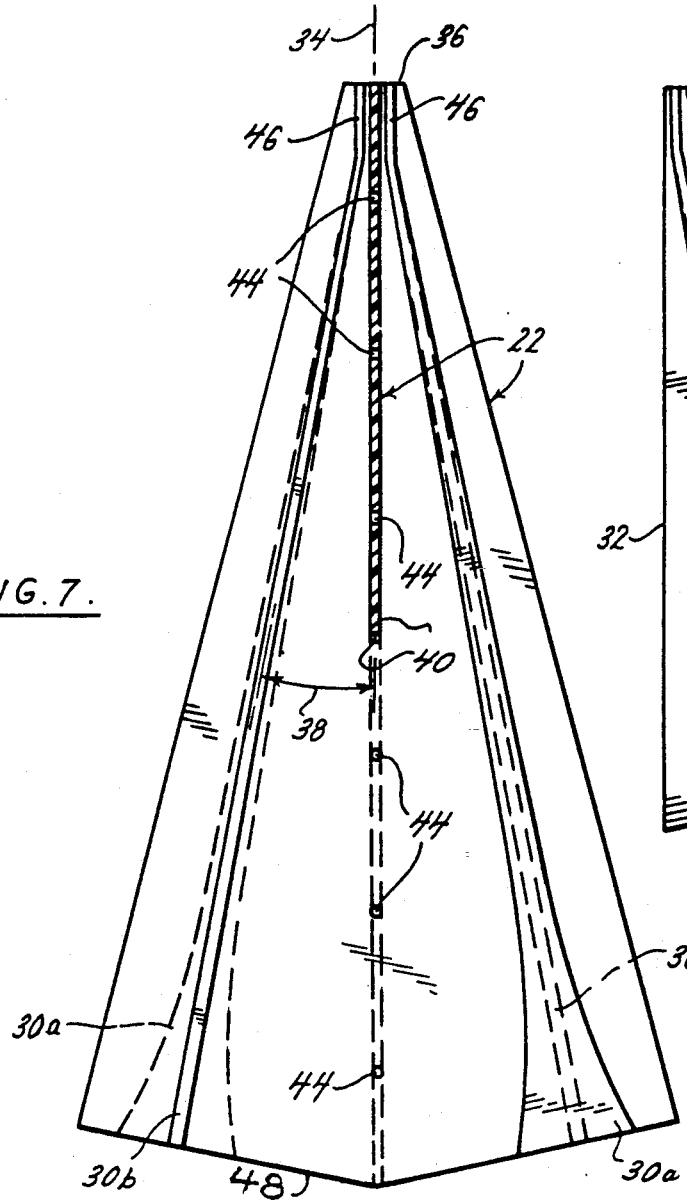
FIG. 7 is a side view of the printed circuit boards of a feed network in which each pair of printed circuit boards formed as a unified structure.

While the printed circuit boards 22 shown in FIG. 2 are substantially triangular in appearance in order to minimize their surface area, they may be constructed in any shape so long as the etched twin leads 30 are appropriately positioned and patterned. Additionally, while each terminal 18 of a multiterminal antenna may have its own dedicated circuit board 22 to carry its signals thereto, it is possible to form a pair of oppositely positioned etched twin leads 30 on a single printed circuit board 22 as shown more clearly in FIG. 7. As known to those skilled in the art, such a design would involve having a printed circuit board 22 with a slot 40 cut at least half as long as the height of the printed circuit board 22 in order to engage another printed circuit board which also has an oppositely positioned slot in this "egg-crate" design. In this fashion the pair of such printed circuit boards 22 can be slid together to form a single unit. Additionally as shown in FIG. 7, one or more holes 44 may be provided in the printed circuit board 22 through which an adhesive material may be entered on both sides of the printed circuit board 22 in order to bond a pair of such printed circuit boards 22 together.

Figure 4:
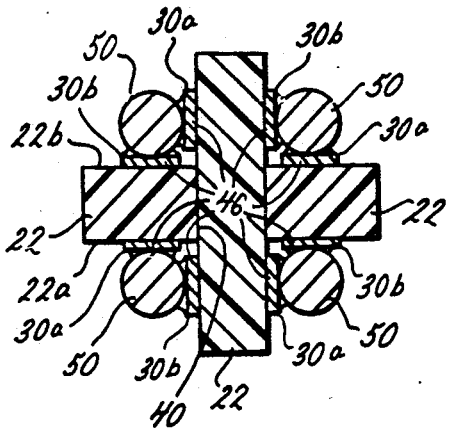
FIG. 4 is a top sectional view of a feed network, taken along line 4—4 in FIG. 2, incorporating the principles of this invention.

A connection is provided from the upper parallel portions 46 of the etched twin leads 30 to the terminals 18 of the antenna 12 being fed be means of a jumper wire 50. As shown in FIG. 4, a jumper wire 50 is electrically connected to a pair of etched twin leads 30. The pair of etched twin leads 30 to which the jumper wire 50 is electrically connected is comprised of a single twin lead 30 from each of two adjacent printed circuit boards 22. In this fashion, the excitation of the multiterminal antenna 12 is ground independent as the jumper wires 50, one of which provides the excitation for each terminal 18 of a multiterminal antenna 12 are fed not from a common ground point as in the prior art approaches, but rather is fed terminal-to-terminal. The use of such a terminal-to-terminal feeding technique provides rotationally symmetric radiation patterns and equal input impedances to each terminal 18 of the antenna 12. Thus, an antenna 12 in accordance with the subject invention provides a wider bandwidth performance over that of prior art multiterminal antennas with a terminal-to-ground excitation.

The etching of the twin lead 30 upon the printed circuit boards 22 is done pursuant to conventional technology. Typically, the printed circuit board 22 is made of a dielectric material such as a fiberglass/epoxy or teflon/fiberglass on which a copper coating is deposited. Subsequently, a photoresistive material is applied to completely cover the copper coating. An artwork mark is thereinafter formed and positioned so as to expose the printed circuit board 22 in only areas in which no twin lead is desired while prohibiting exposure in areas in which a twin lead is desired. Following its exposure to ultraviolet light, the artwork mask is removed and the board 22 is dipped in etchant so as to remove the photoresistive material as well as the copper coating in those areas exposed to ultraviolet light. As a final step, the printed circuit board 22 is placed in a tank filled with tin lead and through electrode deposition, tin lead plating is applied to those areas which have a copper coating thereon. Therefore, the printed circuit boards 22 have twin leads 30 which are two layers in thickness; a first layer of copper coating and a second layer of tin lead plating. The tin lead plating serves to facilitate the subsequent attachment of jumper wires 50.

On a single printed circuit board 22 as shown in FIG. 2, a first twin lead 30*a* is formed on a first side 22*a* of the printed circuit board 22 and a second twin lead 30*b* is formed on a second side 22*b* of the printed circuit board 22. The twin leads 30 extend from the base portion 48 of the printed circuit board 22 to the apex portion 36 of the printed circuit board 22. The width of the twin lead 30 at the base portion 48 of the printed circuit board 22 is equivalent to the diameter of the connector to which the twin lead 30 is electrically connected base portion 25 of the coaxial connector. This equalization of width is to minimize reflections of the signals. Each twin lead 30 is thereafter gradually reduced in width so as to be the width of conventional twin lead 30 conductors by the time the twin lead 30 reaches the apex 36 of the printed circuit board 22. As previously explained, the twin leads 30 proceed along a converging path toward a point slightly lower than the apex 36 of the printed circuit board 22 along its central axis 34. Slightly before each twin lead 30 reaches this point along the central axis 34 of the feed network 10, each twin lead 30 in redirected along a line parallel to the central axis of the feed network so that all twin leads 30 are slightly displaced from one another as shown in FIG. 4. The proximity of such twin leads 30 at the apex 36 of the feed network 10 must only be such that a jumper wire 50 of suitable diameter may be placed in contact between a pair of adjacent twin leads, 30*a* and 30*b*.

Figure 5:
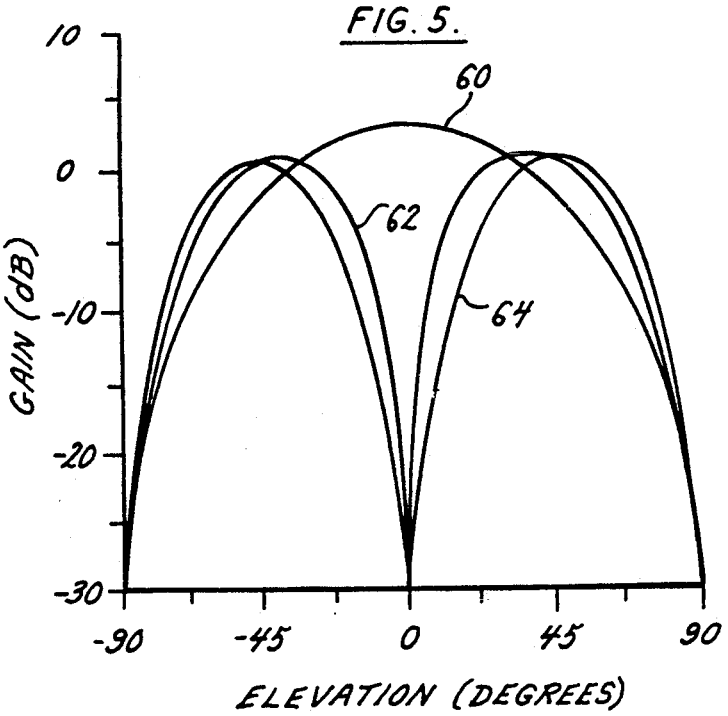
FIG. 5 is a graph of the model elevation patterns for a four-terminal spiral antenna.
Figure 6:
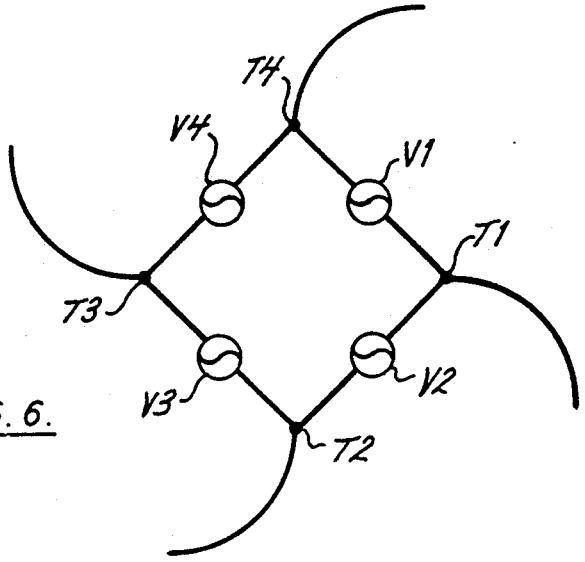
FIG. 6 is a schematic view of the voltages applied to achieve the modal elevation patterns shown in FIG. 5 for a four-terminal spiral antenna.

FIG. 5 shows the modal elevation patterns for a four arm spiral antenna fed by such a feed network. The curves shown in FIG. 5 are for modes 1, 2, and 3 denoted 60, 62 and 64 respectively, which are formed by applying the voltages shown in TABLE 1 between the terminals labeled T1, T2, T3 and T4 of a four arm spiral antenna as shown in FIG. 6.

TABLE 1

| VOLTAGE | MODE 1 | MODE 2 | MODE 3 |
|---|---|---|---|
| $V_1$ | $1\angle 0°$ | $1\angle 0°$ | $1\angle 0°$ |
| $V_2$ | $1\angle 90°$ | $1\angle 180°$ | $1\angle 270°$ |
| $V_3$ | $1\angle 180°$ | $1\angle 0°$ | $1\angle 180°$ |
| $V_4$ | $1\angle 270°$ | $1\angle 180°$ | $1\angle 90°$ |

Although there are many variables in the design of such an antenna feed network system which are well known to those skilled in the art, the upper frequency range of the subject feed network is primarily determined by the thickness of the printed circuit board and the length of the twin lead conductors. Additionally, the lower frequency limit is primarily determined by the length of the tapered twin leads.

Although there has been illustrated and described the specific detail and structure of operations, it is clearly understood that the same were merely for purposes of illustration and that changes and modifications may be readily therein by those skilled in the art without departing from the spirit and scope of the invention.

We claim:

1. A feed network for use with a multiterminal antenna, comprising:

a) a base having one or more coaxial connectors extending therethrough;

b) a plurality of printed circuit boards being positioned symmetrically upon the base having a first side and a second side wherein each of said first sides has a conductor for receiving an excitation signal from the coaxial connectors and each of said second sides have a conductor for connection to the ground of the coaxial connectors; and c) a plurality of means for connecting the conductors for receiving an excitation signal of said printed circuit boards to a terminal of a multiterminal antenna wherein the antenna is fed with a balanced excitation voltage applied between terminals of the antenna.

2. A feed network for use with a multiterminal antenna as recited in claim 1 wherein said printed circuit boards are positioned upon said base such that there is an equal angular displacement between each printed circuit board.

* * * * *